US005303759A

United States Patent [19]

Czech

[11] Patent Number: 5,303,759

[45] Date of Patent: Apr. 19, 1994

[54] DISPENSER FOR APPLYING AN ADHESIVE MATERIAL ONTO A SUBSTRATE

[75] Inventor: Manuel Czech, Donaustauf, Fed. Rep. of Germany

[73] Assignee: Czewo-Plast Kunststofftechnik GmbH, Neutraublin, Fed. Rep. of Germany

[21] Appl. No.: 859,461

[22] PCT Filed: Dec. 19, 1990

[86] PCT No.: PCT/EP90/02240

§ 371 Date: May 28, 1992

§ 102(e) Date: May 28, 1992

[87] PCT Pub. No.: WO91/09805

PCT Pub. Date: Jul. 11, 1991

[30] Foreign Application Priority Data

Dec. 27, 1989 [DE] Fed. Rep. of Germany ..... 8915192
Feb. 15, 1990 [DE] Fed. Rep. of Germany ..... 9001809

[51] Int. Cl.[5] ..... B32B 31/00

[52] U.S. Cl. ..... 156/574; 156/523; 156/577; 156/579

[58] Field of Search ..... 156/523, 526, 527, 530, 156/574, 577, 579, 581

[56] References Cited

U.S. PATENT DOCUMENTS 3,906,186 9/1975 Szolis ..... 156/579 X
4,624,733 11/1986 Homisch, Jr. ..... 156/577 X
4,997,512 3/1991 Manusch ..... 156/577 X

*Primary Examiner*—David A. Simmons
*Assistant Examiner*—James J. Engel
*Attorney, Agent, or Firm*—Nilles & Nilles

[57] ABSTRACT

The invention relates to a dispenser for applying an adhesive material onto a substrate, comprising a housing provided therein with a supply reel holding a carrier strip provided with an adhesive material layer, a take-up device for collecting the carrier strip, and an applicator device for the transfer of the adhesive material layer onto the substrate, the applicator device comprising an applicator body which is movably mounted by means of a mounting construction including concave and convex sliding surfaces, preferably a ball-and-socket pivot.

27 Claims, 6 Drawing Sheets

DISPENSER FOR APPLYING AN ADHESIVE MATERIAL ONTO A SUBSTRATE

BACKGROUND OF THE INVENTION

The present invention relates to a dispenser for applying an adhesive material onto a substrate, comprising a housing provided therein with a supply reel holding a carrier strip provided with an adhesive material layer, a take-up device for collecting the carrier strip, and an applicator device for the transfer of said adhesive material layer onto said substrate, said applicator device including a mounting body fixedly connected to said housing, and an applicator body mounted on said mounting body.

Dispensers of the type defined above are known in various embodiments in the form of readily useable hand-held devices, for instance for applying an adhesive layer onto a substrate or for applying a correction fluid onto a paper substrate for text corrections. In the case for instance of an adhesive dispenser, an adhesive layer of an adhesive strip held on a supply reel is "peeled" off the carrier strip of the adhesive strip at the location of the applicator device and applied onto the substrate, while the bare carrier strip is guided towards a take-up hub or rewinding reel.

From U.S. Pat. No. 3,969,181 there is thus known a dispenser for applying a strip-shaped adhesive coating onto a substrate by separating the adhesive layer from a carrier strip, the applicator device in this case comprising a roller mounted in the housing of the dispenser and provided with a resilient surface layer capable of conforming to the shape of the substrate.

Known from DE Patent 36 44 496 is a hand-held device for applying an adhesive film onto a substrate, in which the applicator device is provided in the form of a resiliently spring-mounted applicator blade over which the carrier strip is reversed.

A dispenser for applying an adhesive material onto a substrate as indicated in the preamble portion of claim 1 is known from EP 0313 719 A2, using an applicator lip for peeling off the adhesive strip from the carrier strip, said applicator lip being made of a material providing some inherent resiliency. Said applicator lip may abut at the top side thereof against a fixed stop member. This support structure comprises curved engaging surfaces in order to allow a certain lateral inclination of the applicator lip, which is fixedly clamped at its inner end to a housing member.

A further improved capability of such dispensers, specifically of the applicator body thereof, in balancing different orientations of the applicator pressure to uniformly apply the adhesive material to the substrate is desired.

SUMMARY OF THE INVENTION

In view of this prior art, it is an object of the invention to improve a dispenser of the type defined in the introduction in such a manner that a uniform application of an adhesive material onto a substrate with a stable application pressure is ensured, and that a uniformly reliable application of the material is also possible at different orientations and varying angular attitudes of the dispenser relative to the substrate.

This object is attained according to the invention by the provision that the applicator body is movably mounted by means of a mounting assembly comprising at least a concave sliding surface and a convex sliding surface.

In a first embodiment of the invention it is preferred that between the mounting body and the applicator body there is provided a ball pivot permitting the applicator body to be universally movable relative to the mounting body and enabling the applicator body to be brought into full pressure contact with the substrate to which the adhesive material is to be applied, even when the device or dispenser is not held in axially parallel alignment with the substrate, so as to ensure both a clearly defined start and a clearly defined end of the adhesive material application.

This mounting of the applicator body permits the dispenser to be employed without problems even at different angular inclinations relative to the substrate onto which for instance an adhesive layer carried on a carrier strip is to be applied, without the occurrence of irregularities in the uniformity of the material application. This is because the concave and convex spherical surfaces of the ball head and the ball socket permit the applicator body to swivel within a wide range relative to the housing-fixed mounting body of the dispenser, and the dispenser to assume different angular orientations relative to the substrate as regards the housing or grip handle of the dispenser.

The dispenser is preferrably used for the application of an adhesive or correction material from a carrier strip inserted into the dispenser in the form of a reel of a carrier strip coated with the adhesive material layer, and adapted to be wound within the dispenser in the form of a coil of the carrier strip from which the adhesive material layer has been stripped.

According to a further preferred embodiment of the invention, the applicator body is mounted on the mounting body for pivoting about a longitudinal axis extending in the direction of application.

In this case, and in accordance with a further preferred embodiment of the invention, the ball pivot may be supplemented with a support device disposed between an applicator lip of the applicator body and the ball pivot, this support device being optionally formed with punctiform, linear or spherically curved complementary support surfaces and cooperating with the ball pivot to define a longitudinal axis of the applicator body about which the latter is pivotable relative to the mounting body.

According to a further embodiment of the invention, a mounting arrangement of this kind permitting the applicator body to pivot about a longitudinal axis may also be obtained by the provision between the applicator body and the mounting body of a shaped cylinder mounting assembly permitting the applicator body to pivot about the longitudinal axis of the cylinder, the convexs cylindrical surface of a shaped cylinder body being in sliding contact with a concave cylindrical bearing surface of a correspondingly shaped bearing body receiving the cylinder body.

The solution according to the second embodiment of the invention likewise ensures the correct adaptation of the applicator body with the carrier strip carrying the adhesive material layer to a substrate, even when the device or dispenser is not held in axial parallel alignment with the substrate, a defined two-point or linear support arrangement being at the same time provided to support the applicator body relative to the mounting body in the direction of the advancing adhesive material application, while permitting the applicator body to perform an angular movement about its longitudinal axis relative to the mounting body, resulting in a highly reliable support of the applicator body on the mounting body. This dispenser is readily and advantageously useable for the application of an adhesive or the application of for instance a correction material for the correction of document or the like, without its field of employ being restricted thereto.

In a preferred embodiment of the invention, the ball head of the ball pivot is formed on the housing-fixed mounting body, and the ball socket, on the applicator body.

In the dispenser according to the invention it is further preferred that the applicator body is provided with a substantialy wedge-shaped applicator lip and preferably formed of a synthetic resin material.

For guiding the carrier strip in conjunction with its being reversed at the applicator lip of the applicator body, the applicator body is preferably provided with downwards extending lateral guide projections for laterally guiding the carrier strip carrying the adhesive material layer.

It is further preferred that the mounting body is fixedly connected, preferably bolted to the housing of the dispenser adjacent an application aperture thereof.

Depending on the specific intended use of the dispenser and on the application conditions, the ball pivot may be interiorly provided with resilient means, for instance a compressible lining, coating or the like to impart certain yield characteristics to the applicator body for increasing its resiliency otherwise depending on the selected material.

In accordance with a further embodiment of the invention, an advantageous construction of the applicator body is achieved by the provision that a bottom face of the applicator body is inclined in the direction towards the applicator lip and cooperates with a front top surface of the applicator body for defining a nose section terminating in the applicator lip defined by an acute angle.

The bottom face of the applicator body extending between the lateral guide projections thereof is preferably inclined at an angle of about 5° relative to a horizontal axis of the ball pivot.

According to a still further preferred embodiment of the invention, the applicator body is pivotally connected to the mounting body by a ball pivot, and additionally provided between an applicator lip of the applicator body and the ball pivot with a spherical support arrangement acting between the applicator body and the mounting body.

In order to enable the applicator body to be smoothly movable in lateral directions relative to the mounting body to a degree permitted by the actual dimensions and construction of the applicator device, the top face of the applicator body facing the mounting body and/or the bottom face of the mounting body facing the applicator body is preferably at least partially crown-faced or of a convex curved shape.

An advantageous construction of the support and mounting of the applicator body on the mounting body can be obtained according to the invention when the ball head of the ball pivot is formed on the housing-fixed mounting body, and the ball socket, on the applicator body.

Preferably the mounting body has its bottom face provided with an additional cylindrical projection having a spherical tip end, while the applicator body is provided with a recess formed as a spherical calotte and facing the cylindrical projection.

The resiliency of the applicator lip of the applicator body can be made adjustable in accordance with the strength of the material by forming the applicator lip so as to project from the applicator body as an extension of an adjacent top face thereof.

The applicator body may also be advantageously designed to be pivotable about a longitudinal axis by providing the top face of the applicator body with an integrally formed ball head, and with an integrally formed cylindrical projection having a spherical tip end and disposed between the applicator lip and the ball head in axial alignment with the latter, while the mounting body is provided with a ball socket for the ball head, and a recess formed as a spherical calotte in a front end portion of its bottom face.

According to another advantageous embodiment of the invention, the applicator body is provided at its top face with an integrally formed mounting projection shaped as a cylindrical body extending in the longitudinal direction at the axial center, while the mounting body is formed with a bearing recess of complementary shape in its bottom face. In this case the axial length of the cylindrical body is selected so as to not encumber a wedge-shaped front end portion of the applicator body including the applicator lip.

It is further preferred that the applicator body is provided at the rear end portion of its top face opposite the applicator lip with a punctiform or linear counterbearing for supporting the applicator body relative to the mounting body. As a result, the rear end portion of the applicator body is reliably supported by the respective portion of the mounting body against a corresponding pressure acting thereon when the dispenser is handled to apply the adhesive material onto a substrate, in which case the applicator body may be simultaneously be supported by the supporting device provided between the ball pivot and the applicator lip, without thereby preventing the applicator body from pivoting about a longitudinal axis pointing in the advance direction of the adhesive material application. This rear counterbearing may preferably be formed as an upstanding ridge extending over the width of the applicator body adjacent the rear end thereof and cooperating with a spherically curved or convex abutment surface formed at the rear end portion of the bottom face of the mounting body.

Embodiments of the invention shall now be explained in more detail by way of example with reference to the accompanying drawings, wherein:

FIG. 1 shows a diagrammatic illustration of a front portion of a dispenser according to a first embodiment of the present invention, with parts of the dispenser broken away, FIG. 2 shows an applicator device of the dispenser shown in FIG. 1, FIG. 3 shows a view similar to FIG. 2, with an applicator body of the applicator device in a pivoted position relative to a mounting body thereof, FIG. 4 shows a sideview of the applicator body according to FIG. 2, FIG. 5 shows a top plan view of the applicator body, FIG. 6 shows a front portion of a dispenser according to a second embodiment of the invention, with parts of the dispenser broken away, FIG. 7*a* shows an enlarged illustration of a mounting body of the applicator device of the dispenser shown in FIG. 6, FIG. 7*b* shows an enlarged illustration of an applicator body of the applicator device of the dispenser shown in FIG. 6, FIG. 8 shows another embodiment of an applicator body of the applicator device for a dispenser according to the present invention, FIG. 9*a* shows a further embodiment of an applicator body for an applicator device of a dispenser according to the present invention, FIG. 9*b* shows an applicator device for a dispenser having an applicator body as shown in FIG. 9*a*.

DESCRIPTION OF THE PREFERRED EMBODIMENT

Figure 1:
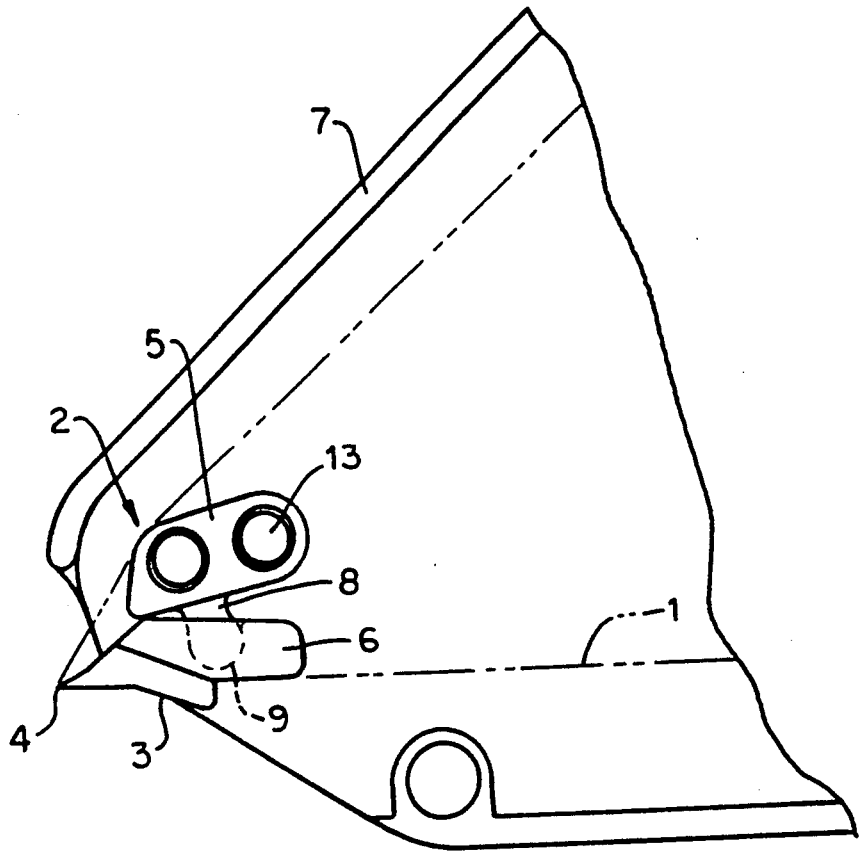

FIG. 1 shows a diagrammatic illustration on an enlarged scale of a front portion of a dispenser according to the present invention designed as a hand-held device for transferring an adhesive material layer from a carrier strip 1 onto a substrate (not shown). The adhesive material layer may for instance be a correction material layer for text corrections or an adhesive layer. The adhesive material layer is disposed on an outer face of carrier strip 1 adapted to be advanced from a supply reel (not shown) over an applicator device 2 disposed adjacent an aperture 3 of the dispenser and comprising an applicator body 6 provided with an applicator lip 4, whereat the adhesive material layer is released from carrier strip 1 and applied onto the substrate, the bare carrier strip 1 being subsequently guided in the direction of the arrow in FIG. 6 onto a (likewise not shown) take-up reel within the dispenser.

The applicator device 2 disposed within the dispenser adjacent aperture 3 is composed of a mounting body 5 and an applicator body 6 preferably formed of a synthetic resin material as is also a housing 7 of the dispenser.

Mounting body 5 is fixedly secured within housing 7 of the dispenser by means of preferably threaded fastener means 13. Mounting body 5 may be oriented within housing 7 in any suitable manner, FIG. 1 showing just one such orientation by way of example. Provided on the bottom face of mounting body 5 is a projecting ball head 8 adapted to be received in a complementary ball socket 9 of applicator body 6, the thus formed ball pivot 8, 9 being effective to space applicator body 6 from mounting body 5 while permitting applicator body 5 to assume different angular orientations relative to mounting body 5, the latter being secured to housing 7 at a fixed position.

Figure 2:
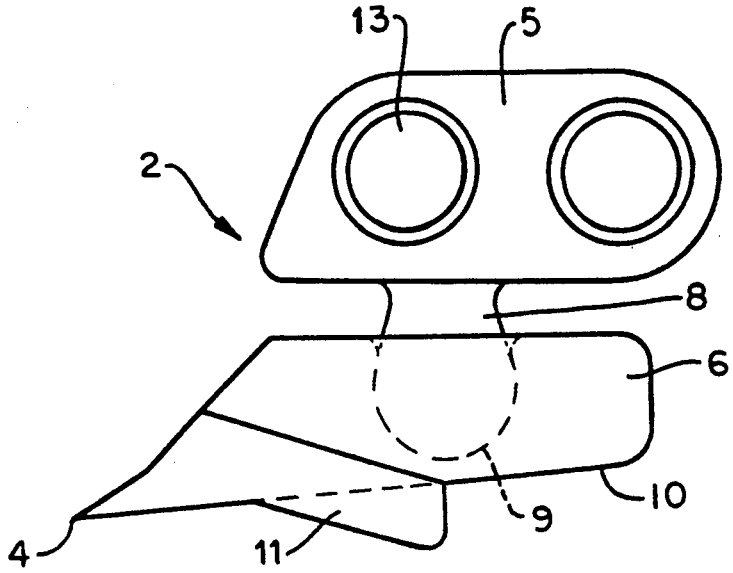
Figure 3:
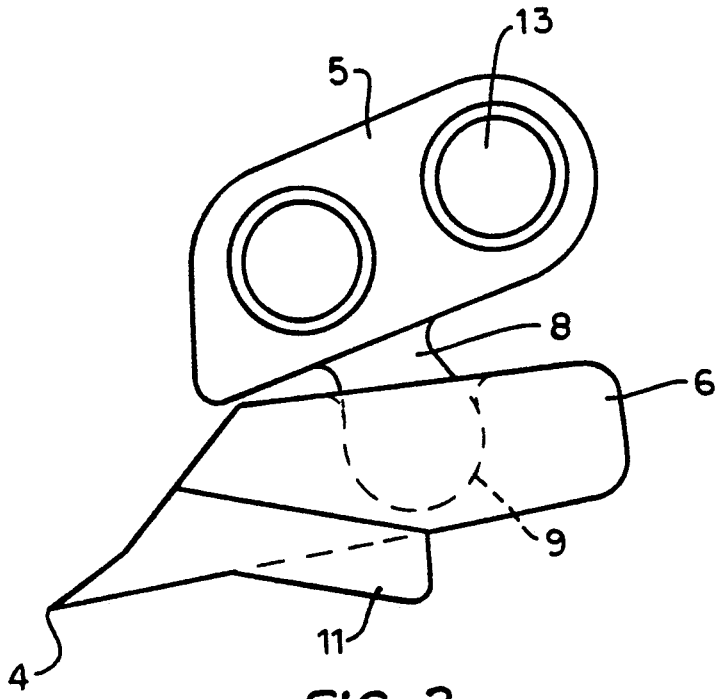

FIGS. 2 and 3 show enlarged illustrations of applicator device 2 in which applicator body 6 is oriented at different angles relative to mounting body 5.

Applicator body 6 has a bottom face 10 acting as a guide surface for carrier strip 1 with its adhesive material layer, and laterally bounded by downwards extending guide projections 11 integrally formed with applicator body 6.

Guide projections 11 are disposed opposite one another and act to laterally support carrier strip 1 with its adhesive material coating, for instance a correction coating layer.

The ball pivot 8, 9 between mounting body 5 and applicator body 6 permits the latter to pivot relative to the former in any direction within a wide angular range within the limits imposed by the overall mounting construction and the spacing between mounting body 5 and applicator body 6, so that applicator lip 4 of applicator body 6, over which carrier strip 1 is guided and whereat the adhesive material layer is peeled off carrier strip 1 as the latter is being reversed over applicator lip 4, can always be brought into full contact with the substrate to reliably ensure the exertion of a uniform pressure on the substrate by applicator lip 4.

The application of the adhesive material layer by means of the dispenser according to the invention is thus advantageously not dependent on an accurately parallel orientation of housing 7 relative to the substrate, applicator body 6 with its applicator lip 4 being able to orient itself for full surface contact with the substrate, with the interposition of carrier strip 1, even when the dispenser is not held at the correct angular orientation. This is also helpful for obtaining a clearly defined start and a defined end of the adhesive material application onto the substrate, this aspect being particularly advantageous in the case of text corrections by the application of a correction coating layer.

FIG. 3 shows applicator device 2 with applicator body 6 oriented at a different angle relative to mounting body 5 corresponding to a determined inclination of the dispenser in use.

Although not illustrated in detail, the bottom face of mounting body 5 and/or the top face of applicator body 6 may be provided with a spherically curved or convex profile at a front and/or rear end portion, or mounting body 5 and applicator body 6 may be provided, in addition to ball pivot 8, 9, with auxiliary support means in the form of an upstanding ridge cooperating with a convex countersupport surface permitting applicator body 5 to perform a rolling pivot movement relative to mounting body 5.

Figure 4:
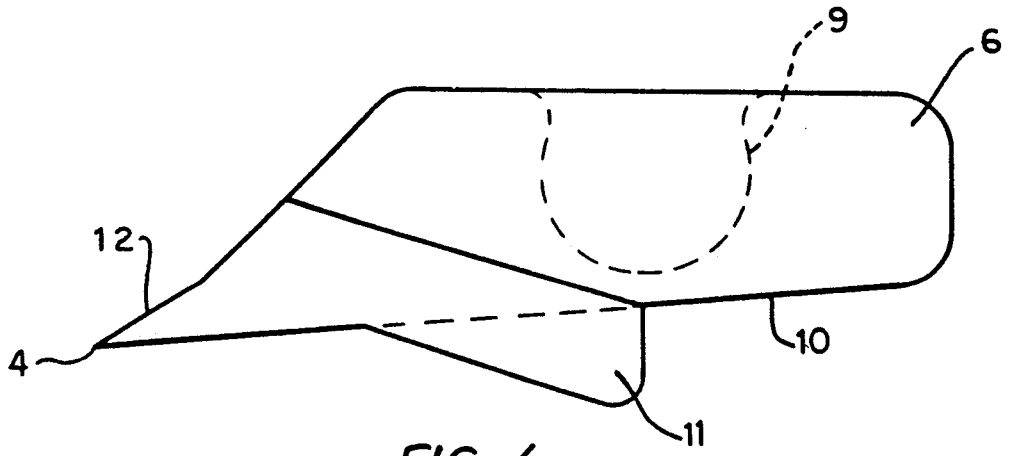
Figure 5:
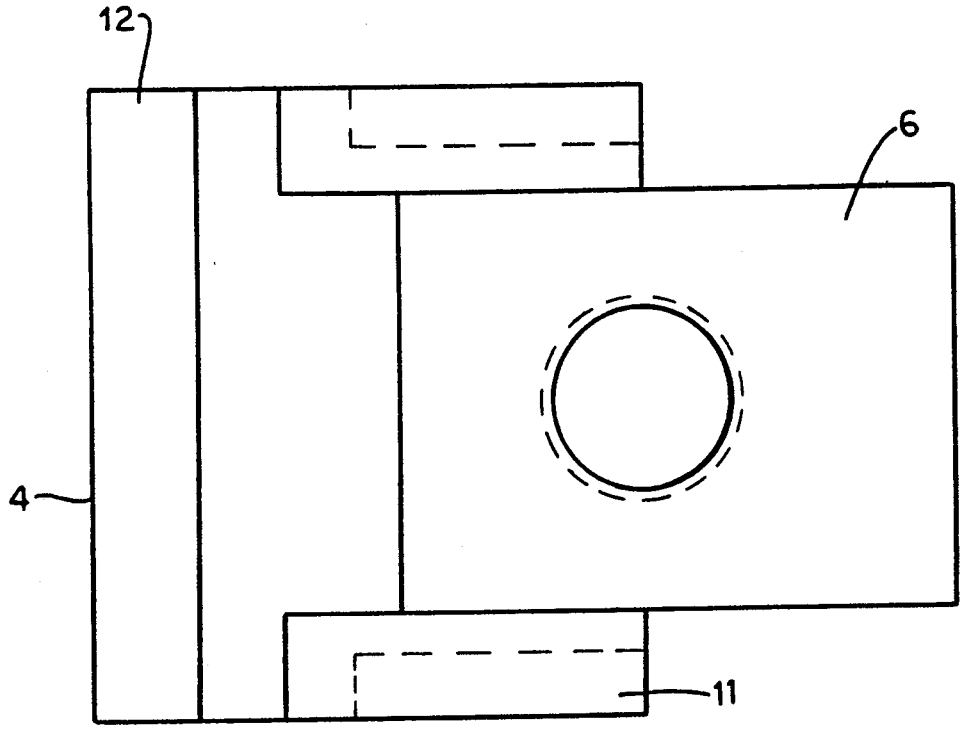

FIGS. 4 and 5 show enlarged views of the applicator body 6 alone, the top plan view of FIG. 5 showing with particular distinctiveness the guide projections 11 integrally formed with applicator body 6 on opposite sides for the lateral support of carrier strip 1. Particularly shown in FIG. 4 is the configuration of applicator body 6 defining its applicator lip 4, to which purpose bottom face 10 encloses an acute angle with the top face of applicator body 6, resulting in the formation of a nose section 12 terminating in applicator lip 4.

In the embodiment shown, the ball pivot 8, 9 between mounting body 5 and applicator body 6 is illustrated as a non-resilient or rigid swivel connection (neglecting in this context the inherent resiliency of the material of which the parts are made). Although this swivel connection nevertheless permits applicator body 6 to assume widely varying angles relative to housing 7 to conform to varying application conditions and handling of the dispenser, it is also possible to provide resilient dampening means. For instance, a coating or a liner may be provided within the ball pivot 8, 9; or the ball pivot 8, 9 may be constructed to have an inherent resiliency exceeding the resiliency of the material itself and permitting applicator body 6, particularly and preferably adjacent its applicator lip portion 4, to yield to a pressure force exerted on applicator device 2 in use of the dispenser.

A dispenser of the type according to the invention is useful for applying the most different adhesive materials onto respective substrates, e.g. for applying adhesive coatings or correction materials for text corrections. In any of these cases, the adhesive material layer of carrier strip 1 is peeled off the strip and applied onto a substrate at the location of applicator lip 4, the bare carrier strip 1 being reversed over the applicator lip 4. The dispenser is also useful for other coating operations, e.g. for applying a lubricant film or the like onto a respective substrate.

Figure 6:
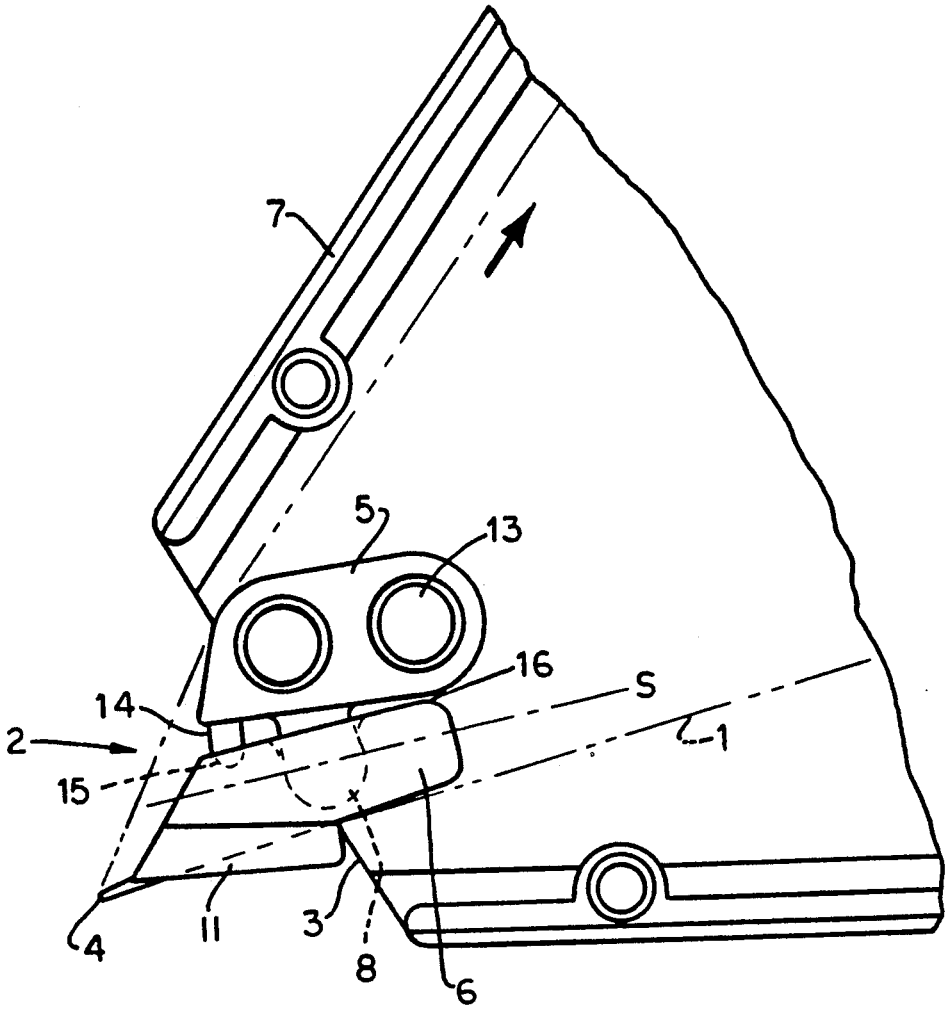

FIG. 6 shows a diagrammatic illustration on an enlarged scale of a front portion of a dispenser according to a second embodiment of the invention, the dispenser being likewise designed as a hand-held device for applying an adhesive material layer, such as a correction coating layer or an adhesive coating, onto a substrate not shown in the drawing. In contrast to the first embodiment described above, however, this dispenser is designed to define a longitudinal axis extending in the direction of the advancing adhesive material application, i.e. in the longitudinal direction of applicator body 6, about which the latter is pivotable in operation. This longitudinal axis may for instance be defined by a convex sliding surface of ball head 8 and the concave sliding surface of ball socket 9 in combination with a convex sliding surface of a cylindrical projection 14 and a concave sliding surface of a spherical recess 15. A construction of this kind results in a defined mounting of applicator body 6 affording it sufficient freedom to pivot about the longitudinal axis S relative to mounting body 5 as required by the conditions of the application operation.

From FIG. 6 it is also evident that applicator lip 4 of applicator body 6 has a higher degree of resiliency in a direction perpendicular to longitudinal axis S. To this purpose, applicator lip 4 projects from applicator body 6 in a different manner as in the first embodiment, so that a preferably blunt angle is formed between applicator lip 4 and the adjacent top face of applicator body 6.

In the embodiment according to FIGS. 6 and 7, the longitudinal axis S acting as the pivot axis of applicator body 6 and extending in the direction of the advancing adhesive material application is defined adjacent the bottom side of mounting body 5 by ball head 8 of the ball pivot 8, 9 and a semispherical tip portion of cylindrical projection 14. Projection 14 cooperates with a semispherical recess 15 in the top face of applicator body 6 to act as a support and/or guide means cooperating with the mounting of ball head 8 in ball socket 9 to act as a two-point mounting of applicator body 6 defining the longitudinal axis S about which applicator body 6 is pivotable relative to mounting body 5.

In order to facilitate the pivoting of applicator body 6 about the longitudinal axis S defined by ball pivot 8, 9 and the combination of cylindrical guide projection 14 and semispherical recess 15, the rear end portion 16 of applicator body 6 is preferably supported on mounting body 5. For this purpose, rear end portion 16 of applicator body 6 and/or a corresponding portion of mounting body 5 may be formed with a convex arcuate profile in the transverse direction to enable applicator body 6 to perform the desired rolling movement about axis S in a particularly satisfactory manner.

In this manner applicator body 6 is reliably and positively supported by mounting body 5 in the direction of the width of the adhesive material application from carrier strip 1 onto the substrate. This in turn enables applicator body 6 to perform a rolling or pivot movement about longitudinal axis S to thereby facilitate the handling of the dispenser and permit a particularly effective angular orientation of applicator lip 4 during application of the adhesive material, for instance an adhesive coating or a correction material, from carrier strip 1 onto a substrate, with an accurately defined start and end of the adhesive material application.

It is of course also possible to provide a defined bearing support at the location of the rear support 16 between mounting body 5 and applicator body 6. For instance, a bearing support could be formed forming one of the two members 5 or 6 with a projecting edge, an upstanding longitudinal ridge or a transversely extending fin adapted to roll on a convex arcuate counterbearing surface of the other of the two members 6 or 5 when applicator body 6 pivots about longitudinal axis S.

In the embodiment of FIG. 6, applicator body 6 is likewise provided with lateral support or guide projections 11 for the lateral support of carrier strip 1. As particularly shown in FIG. 7*b*, applicator lip 4 of applicator body 6 is formed as a projecting element combining sufficient stiffness with a certain degree of resiliency and permitting carrier strip 1 to be accurately placed on a substrate.

As in the case of the first embodiment shown in FIGS. 1 to 5, mounting body 5 is secured at a fixed position in housing 7 by fastener means 13.

Figure 7A:
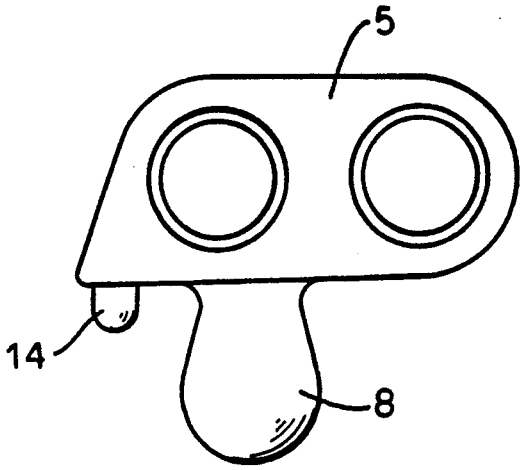
Figure 7B:
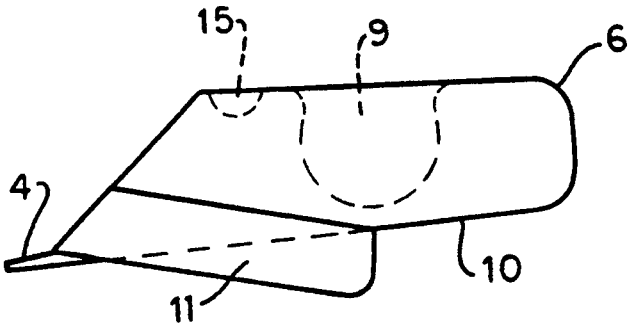

FIGS. 7*a* and 7*b* respectively show mounting body 5 and applicator body 6 in the embodiment according to FIG. 6. Applicator body 6 has a bottom face 10 acting as a guide surface for the coated carrier strip 1 and bounded on opposite sides by downwards extending guide projections 11 formed integrally with applicator body 6 contributes to an accurate application performance of the dispenser and to a full surface contact between carrier strip 1 and the substrate.

The components of the dispenser are preferably all devised as low-cost synthetic resin injection mouldings.

Figure 8:
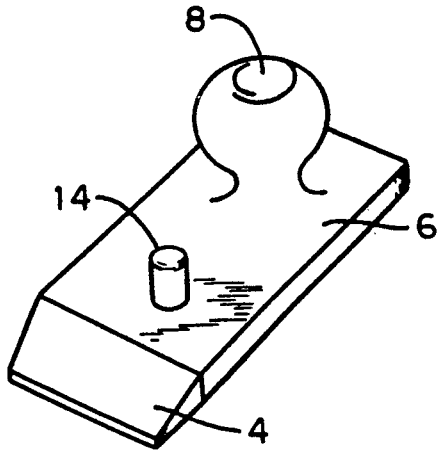

The complementary support and mounting elements between mounting body 5 and applicator body 6, i.e. for instance ball head 8 and cylindrical projection 14, or ball socket 9 and semispherical recess 15, respectively, may or course be provided on the other one of the two members 5 and 6. An example of an applicator body 6 of this construction is diagrammatically depicted in FIG. 8, wherein support or guide projection 14 and ball head 8 project from the top face of applicator body 6 for engagement with complementary recesses of a mounting body not shown in FIG. 8.

Figure 9A:
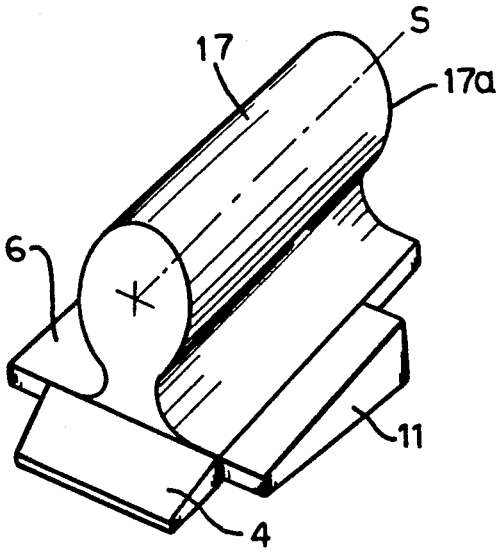
Figure 9B:
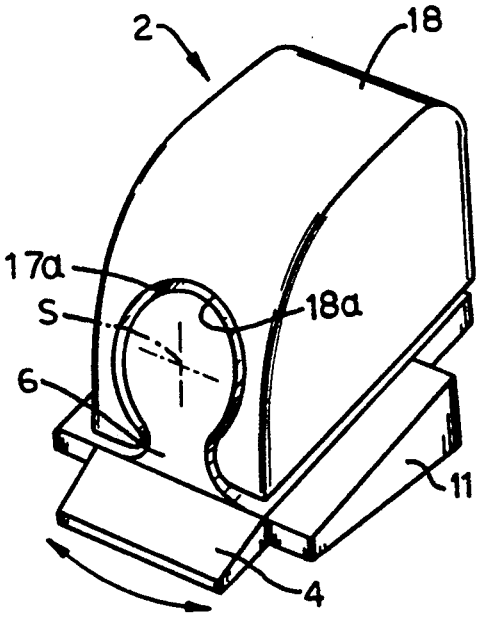

Shown in FIG. 9 is a still further embodiment of an applicator body 6 provided on its upper side with an integrally formed cylinder body 17 having a cross-sectional shape similar to that of the handle of a rubber stamp, with a bearing section preferably formed as a circular cylinder 17*a* adapted to be received in a complementary elongate bearing seat 18*a* of a bearing member 18 formed as part of a mounting body 5 not shown in FIG. 9. The circular cylindrical configuration of cylinder body 17 of applicator body 6 permits the latter to pivot relative to bearing member 18 about the longitudinal axis S of cylinder body 17, permitting applicator body 6 with its applicator lip 4 to assume any desired angular orientation within a limited range by pivoting about longitudinal axis S in the direction of the arrow in FIG. 9*b*, it being of course also possible to provide the shaped cylinder body 17 on mounting body 5, and bearing member 18 on applicator body 6. In this embodiment, applicator body 6 may also be provided with lateral guide projections 11 for the carrier strip (not shown in this figure). It is also possible, however, to guide the carrier strip in any other suitable manner.

FIG. 9 shows applicator body 6 mounted in bearing member 18 for pivoting about its longitudinal axis S in the direction indicated by a double arrow. Bearing member 18 is preferably formed as an integral component of a mounting body (not shown in detail in this figure).

In a modification of this embodiment of the invention, it would also be possible to design the ball head 8 in FIG. 7*a* as a longitudinally extending central cylinder body for cooperation with a suitably shaped bearing recess in applicator body 6.

This second embodiment of the invention is particularly characterized in that applicator body 6 can adapt itself to a substrate by performing a rolling or pivoting movement about a longitudinal axis and widthwise of carrier strip 1, while being preferably additionally supported by mounting body 5.

If so desired, ball pivot 8, 9 or cylinder bearing assembly 17, 18 may be provided with resilient dampening means in the form of a resilient coating, a lining or the like, or ball pivot 8, 9 itself may be of a construction imparting to it an inherent resiliency exceeding the resiliency resulting from the configuration of the applicator lip 4 and the material employed therefor, so that the applicator device displays a certain yielding characteristic in response to a pressure exerted thereon during the application process. A dispenser with an applicator device according to the further embodiments of the invention is also useful for use with different coating materials and applications, for instance adhesive coatings, the correction film coatings and the like, in combination with carrier strips selected to suit the given purpose as regards the material and surface characteristics thereof.

I claim:

1. A dispenser for applying an adhesive material onto a substrate, comprising: a housing provided therein with a supply reel holding a carrier strip provided with an adhesive material layer, a take-up device for collecting the carrier strip, and an applicator device for the transfer of said adhesive material layer onto said substrate, said applicator device including a mounting body fixedly connected to said housing, and an applicator body mounted on said mounting body; wherein said applicator body in its entirety is supported on said mounting body by means of a mounting assembly comprising at least a concave sliding surface and a convex sliding surface, said mounting assembly enabling the whole applicator body to swivel relative to the mounting body.

2. A dispenser according to claim 1, wherein said applicator body is mounted on said mounting body by means of a ball pivot assembly.

3. A dispenser according to claim 1, wherein said applicator body is mounted on said mounting body for a multi-axes movement by means of a ball pivot assembly.

4. A dispenser according to claim 1, wherein said applicator body is mounted on said mounting body for pivoting about a longitudinal axis extending in the direction of application.

5. A dispenser according to claim 1, wherein said applicator body is connected to said mounting body by a ball pivot assembly, and a support device is provided between said applicator body and said mounting body and is disposed between an applicator lip of said applicator body and a ball head of said ball pivot assembly in axial alignment therewith.

6. A dispenser according to claim 1, wherein said support device comprises spherical support elements.

7. A dispenser according to claim 5, wherein the ball head of said ball pivot is formed on said mounting body, and a ball socket is formed on said applicator body.

8. A dispenser according to claim 5, wherein said applicator body is provided with a wedge-shaped applicator lip.

9. A dispenser according to claim 8, wherein said applicator body is provided with a bottom face acting as a guide surface for said carrier strip, and is integrally formed with lateral guide projections for laterally guiding said carrier strip provided with said adhesive material layer.

10. A dispenser according to claim 1, wherein said mounting body is fixedly connected to said housing of the dispenser adjacent an application aperture thereof.

11. A dispenser according to claim 1, wherein within said mounting assembly there is provided one of an elastic spring, a coating and a liner.

12. A dispenser according to claim 9, wherein said bottom face is inclined towards said applicator lip relative to a horizontal main axis of said ball pivot, and a front top surface of a nose section encloses an acute angle with said bottom face to thereby define said applicator lip.

13. A dispenser according to claim 4, wherein said mounting assembly includes a support device connecting said applicator body and said mounting body, an integrally projecting ball head formed on a top surface of said applicator body, and a ball socket formed on a bottom surface of said mounting body, said ball socket receiving said ball head therein to form a ball pivot, said ball pivot acting to spacedly and movably connect said applicator body to said mounting body and cooperating with said support device for defining a pivot axis of said applicator body.

14. A dispenser according to claim 13, wherein said support device comprises a cylindrical projection formed with a spherical end section, and a recessed semi-spherical calotte.

15. A dispenser according to claim 14, wherein said cylindrical projection is provided on one of said mounting body and said applicator body together with said ball head, and said recessed semi-spherical calotte is provided on the other of said applicator body and said mounting body together with said ball socket, said cylindrical projection being longitudinally spaced from said ball head.

16. A dispenser according to claim 1, characterized in that a top face of said applicator body (6) facing said mounting body (5) and/or a bottom face of said mounting body (5) facing said applicator body (6) is at least partially crown-faced, particularly of convexely curved shape.

17. A dispenser according to claim 14, wherein said applicator body is provided with an inclined applicator lip.

18. A dispenser according to claim 1, wherein said applicator body has a rear section of its top face provided with a counterbearing for one of a punctiform and linear supporting contact of said applicator body on said mounting body.

19. A dispenser according to claim 1, wherein said mounting body has a rear section of its bottom face provided with a counterbearing for one of a punctiform and linear support contact with said applicator body.

20. A dispenser according to claim 4, wherein the top of said applicator body has a convex slide bearing surface which is received in a bearing for pivoting about its longitudinal cylinder axis.

21. A dispenser for applying an adhesive material to a substrate, said dispenser comprising:

a housing;

an applicator device for transferring said adhesive material layer onto said substrate, said applicator device including a mounting body fixedly connected to said housing, an applicator body, an applicator provided on said applicator body, and a mounting assembly via which said applicator body is pivotably mounted on said mounting body, said mounting assembly including a first sliding surface located on a generally downwardly facing surface of said mounting body a second sliding surface located on a generally upwardly facing surface of said applicator body, one of said first and second surfaces comprising a convex surface and the other of said first and second surfaces comprising a concave surface, said mounting assembly enabling the entire applicator body to pivot relative to said mounting body.

22. A dispenser according to claim 21, further comprising a cylindrical mounting assembly disposed between said applicator body and said mounting body and permitting said applicator body to pivot about a longitudinal axis.

23. A dispenser according to claim 21, wherein said mounting assembly comprises mating hemispherical ball and socket members.

24. A dispenser according to claim 23, wherein said mounting assembly further comprises a cylindrical projection and a mating calotte spaced longitudinally from said ball and socket members.

25. A dispenser according to claim 21, wherein said mounting assembly comprises a semi-cylindrical body presenting said convex slide bearing body and a semi-cylindrical bearing body presenting said concave slide bearing body.

26. A dispenser according to claim 21, wherein said applicator body is mounted on said mounting body for pivoting about a longitudinal axis extending in the direction of application.

27. A dispenser according to claim 26, wherein the bottom face of said mounting body is provided with an integrally formed cylindrical body having a convex slide bearing surface and received in a bearing socket having a concave slide bearing surface of said applicator body so as to mount said applicator body for pivoting about a longitudinal axis of said bearing socket.

* * * * *